US005087048A

United States Patent [19]

Sun et al.

[11] Patent Number: 5,087,048

[45] Date of Patent: Feb. 11, 1992

[54] GOLF BALL

[76] Inventors: Donald J. C. Sun; Charles S. C. Su, both of 4521 Ocean Valley La., San Diego, Calif. 92130

[21] Appl. No.: 552,089

[22] Filed: Jul. 13, 1990

[51] Int. Cl.[5] ..... A63B 37/14

[52] U.S. Cl. ..... 273/232; 40/327

[58] Field of Search ..... 273/232, 62, 220; 40/327

[56] References Cited

U.S. PATENT DOCUMENTS

| | | | |
|---|---|---|---|
| 4,744,564 | 5/1988 | Yamada | 273/232 |
| 4,804,189 | 2/1989 | Gobush | 273/232 |
| 4,813,677 | 3/1989 | Oka et al. | 273/232 |
| 4,915,389 | 4/1990 | Ihara | 273/232 |
| 4,919,434 | 4/1990 | Saito | 273/235 R |
| 4,921,255 | 5/1990 | Taylor | 273/232 |

FOREIGN PATENT DOCUMENTS

| | | | |
|---|---|---|---|
| 0218311 | 4/1987 | European Pat. Off. | 273/232 |

*Primary Examiner*—George J. Marlo

*Attorney, Agent, or Firm*—William W. Haefliger

[57] ABSTRACT

A golf ball characterized by enhanced flight distance and enhanced aerodynamic symmetry, the ball having a generally spherical surface with dimple patterns thereon, the improvement comprising between about 75% and 85% of the ball spherical surface occupied by the dimples; there being smaller and larger dimples, all of which have diameters within the range of about 0.110 to 0.150 inches. There are dimple-free multiple great circle arcs on the ball surface, which define n-sided spherical surface polygons associated with opposite polar zones, with $n^2-2n$ of the smaller dimples within each polygon. The ball also has an equator, and great circle arcs also defining multiple spherical surface triangles with legs on the equator, there being $n^2+2n$ of the smaller dimples within each triangle.

10 Claims, 2 Drawing Sheets

GOLF BALL

BACKGROUND OF THE INVENTION

This invention relates to a golf ball, and more specifically, to a golf ball with the characteristics of improved distance and improved aerodynamic symmetry. The golf ball has a dimpled surface with the dimples arranged on the surface inside patterns created by a series of arcs of great circles. The pattern is such as to allow a large percentage of the surface of the ball to be covered by dimples and to minimize the negative aerodynamic effect of the undimpled equator while still maintaining aerodynamic symmetry without the need for changing the depth of the dimples in the polar regions of the ball.

U.S. Pat. No. 4,744,564 discloses a means of achieving aerodynamic symmetry on a golf ball by decreasing the depth and therefore volume of dimples in the polar regions of the ball. It has long been known to those familiar with the art that for a given dimple size on a golf ball of a particular construction, there is one and only one depth which will optimize the performance of that ball in terms of distance. Changing the depth of the dimples in a particular region on the ball may improve the aerodynamic symmetry of the ball, but will have a detrimental effect on the distance of the ball.

U.S. Pat. Nos. 4,560,168 issued to Aoyama and 4,142,727 issued to Shaw et al. both disclose dimple patterns which achieve symmetry by having multiple great circles on the sphere which are dimple free, thus acting as false equators or parting lines. It is known to those skilled in the art, however, that it is undesirable to have dimple-free circumferential paths around the surface of the ball if maximum distance is to be achieved. This fact is pointed out in Uniroyal U.S. Pat. No. 1,407,730.

SUMMARY OF THE INVENTION

It is a major object of the invention to provide dimples of different sizes located in patterns on the ball surface, such that both enhanced flight distance and aerodynamic symmetry are achieved.

Basically, the ball has dimple patterns characterized by formation of undimpled arcs of great circles on the ball surface. Such arcs include spherical pentagons at the poles of the ball, and spherical triangles which touch the equator of the ball. On each half of the ball there are typically five spherical triangles which have a leg on the equator of the ball, and five spherical triangles which have an apex on the equator of the ball.

The disclosed golf ball has two dimple sizes on its surface. The majority of the dimples are 0.140+/−0.002 inches in diameter; and the minority of the dimples are 0.135+/−0.002 inches in diameter. The combination of the locations of the arcs of the great circles and the placement of these smaller dimples is effective to achieve aerodynamic symmetry. The smaller dimples are somewhat deeper than the larger dimples having a ratio of depth to diameter of about 0.055 as compared to a ratio of about 0.047 for the larger dimples. More turbulence is created on the surface of the ball by these deeper dimples. Hence the flight of the ball in particular orientations can be affected by the location or placement of these dimples on the ball.

These and other objects and advantages of the invention, as well as the details of an illustrative embodiment, will be more fully understood from the following specification and drawings, in which:

DRAWING DESCRIPTION

DETAILED DESCRIPTION

Figure 1:
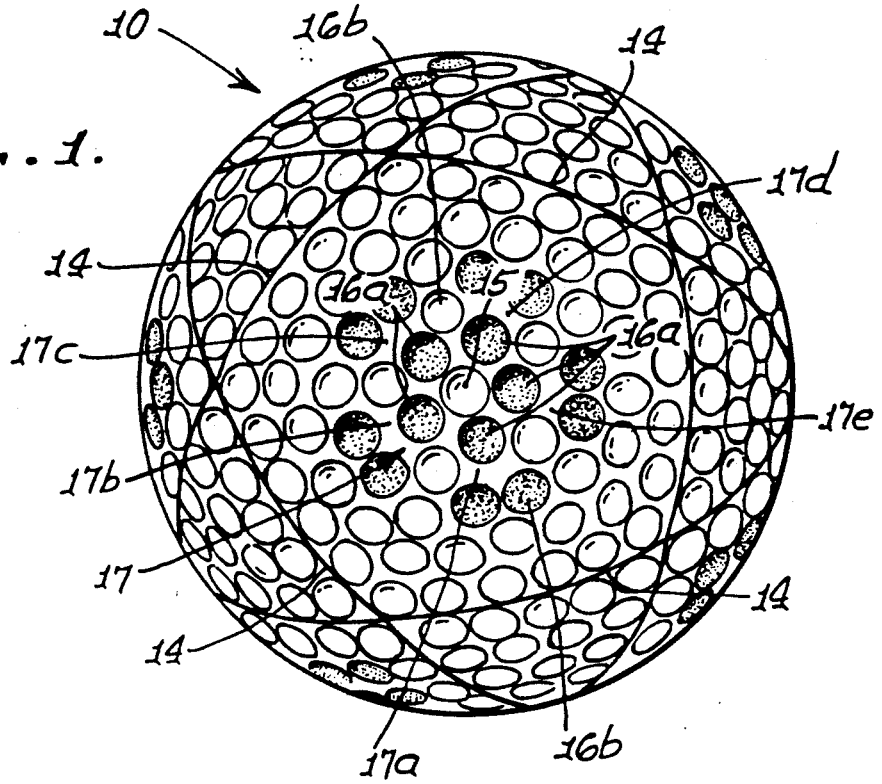
FIG. 1 is a polar view of one hemisphere showing the dimple pattern of this invention, the opposite polar view being the same.

In the drawings, a golf ball 10 is of standard size, as for example 1.68 inches in diameter. It has opposite polar regions at 11 and 12, and an equator, as indicated by great circle 13.

There are dimples of two different sizes on or associated with the ball surface, and typically between about 75% and 85% of the ball surface is occupied by such dimples. More specifically, and preferably, as enabled by the invention, between about 78% and 82% of the ball surface is covered with the dimples.

The golf ball, as shown, has two dimple sizes on its surface. The majority of the dimples are 0.140+/−0.002 inches in diameter. The minority of the dimples are 0.135+/−0.002 inches in diameter.

The smaller dimples are somewhat deeper than the larger dimples having a ratio of depth to diameter of about 0.055 compared to a ratio of about 0.047 for the larger dimples. More turbulence is created on the surface of the ball by these deeper dimples. Hence the flight of the ball in particular orientations can be affected by the location or placement of these dimples on the ball.

It has been discovered if dimples on the surface of a golf ball are constrained by a polygon of "n" sides at the pole of the ball, there should be $n^2-2n$ of the aforementioned smaller and deeper dimples near each pole of the ball and $n^2+2n$ of the smaller and deeper dimples on each side of the equator of the ball in order to achieve optimum aerodynamic symmetry.

As an example, a spherical surface pentagon is defined by equal length great circle arcs 14 spaced equally from the ball axis 15. Such arcs are characterized as undimpled; and a similar pentagon is defined at the opposite polar region of the ball. Each such pentagon is within the scope of a polygon of "n" sides, "n" being 5 in this case. The smaller dimples 16 are distributed about axis 15, as seen in FIG. 1, there being one group of five such smaller dimples **16*a* spaced about and closest to axis 15; and there being another or second group of these such smaller dimples 16*b* spaced about and further from axis 15, pairs of adjacent dimples 16*b* spaced outwardly from individual dimples 16*a*, respectively, as indicated by spaces 17 which have five sides 17*a*–17*e*. A large size dimple is located at the exact pole. The total number of smaller dimples within the pentagon is 15**, satisfying the formula $5^2-2\times5$.

Figure 4:
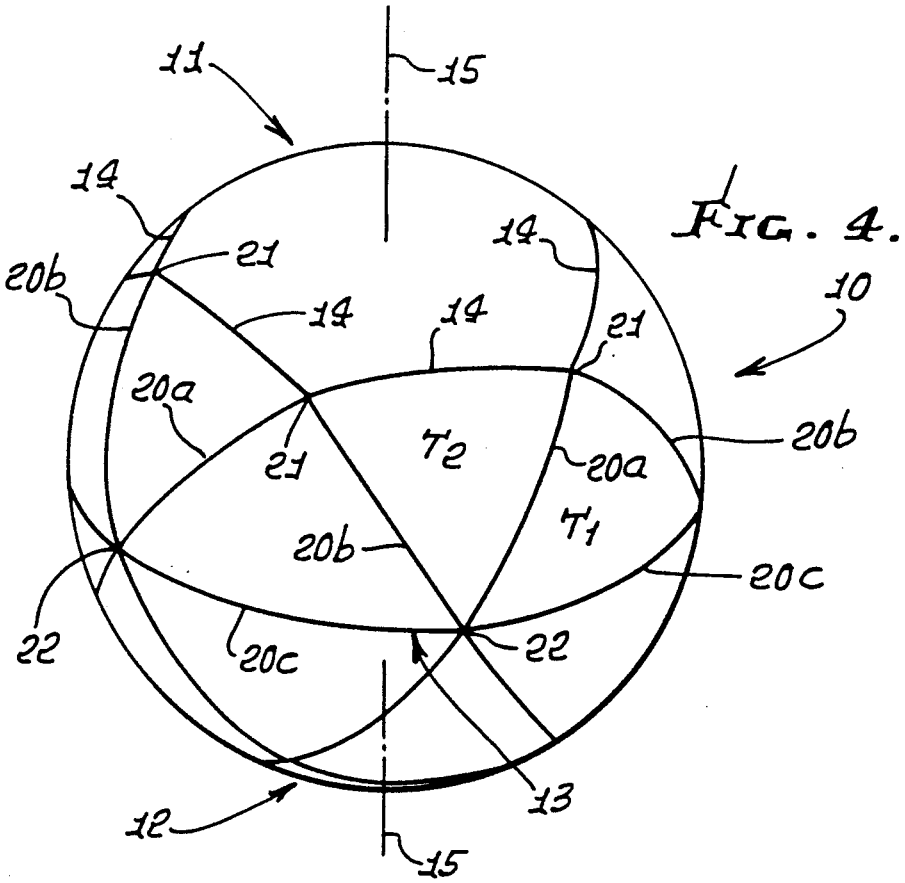
FIG. 4 is a side view of one hemisphere, like FIG. 2, with no dimples shown but with undimpled great circle arcs illustrated.

Further, in FIG. 4, the great circle arcs shown form spherical surface triangles; i.e., note like triangles $T_1$ formed by undimpled arcs **20*a*, 20*b*, and 20*c*, and like triangles $T_2$ formed by undimpled arcs 20*a*, 20*b* and 14**.

Five arcs 20c form the complete equator; and the five triangles $T_1$, plus the five triangles $T_2$, form a band about the ball surface between the equator and the pentagons. This construction is the same for each of the upper and lower hemispheres of the ball. See also arc intersections 21 and 22.

Figure 2:
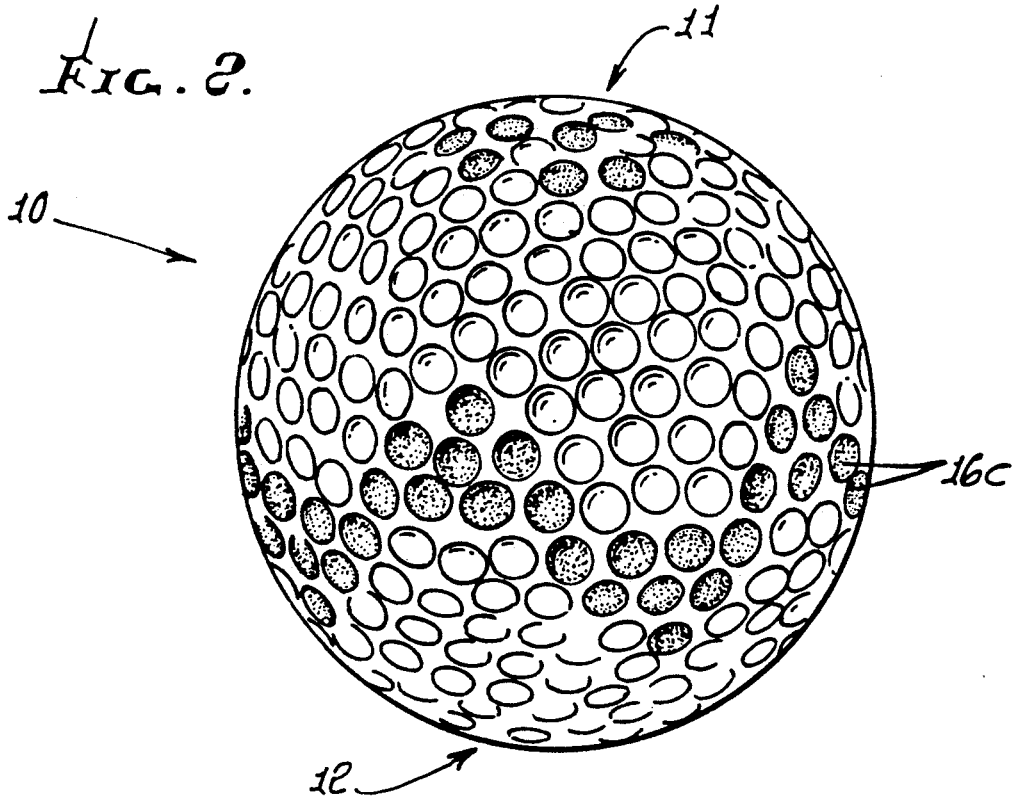
FIG. 2 is a side view of the hemisphere showing the dimple pattern of the invention at ball equatorial regions, the opposite hemisphere being the same.
Figure 3:
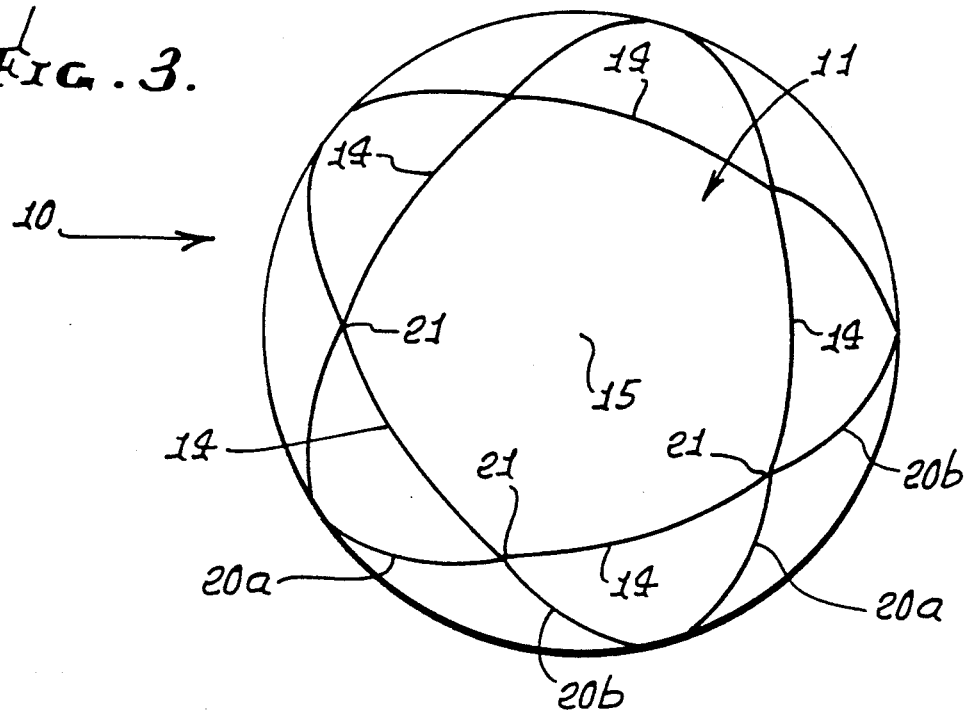
FIG. 3 is a polar view like FIG. 1 with no dimples shown, but with undimpled great circle arcs illustrated.

The dimples are located within the constraining patterns of arcs, as shown. Smaller dimples 16c lie about the equator, within the triangles $T_1$ and $T_2$; and each trianglar group of such smaller dimples includes eight such dimples. The total number of such smaller dimples in the triangles $T_1$ and $T_2$ at each side of the equator is 35, satisfying the formula $5^2+2\times5$. Only a portion of these is visible in FIG. 2, the balance being on the opposite or back side of the ball sphere.

As referred to above, optimum distance for a golf ball is achieved when a minimum of about 75% and a maximum of about 85% of its spherical surface is covered with dimples, and more specifically, when a minimum of about 78% and a maximum of about 82% of its surface is covered with dimples. This coverage may be achieved with a multitude of different dimple sizes all of which will be in the range of diameters of about 0.110 inches to about 0.160 inches, and which have a specific ratio of depth to diameter for a given dimple size with the smaller dimples being deeper and having a higher depth to diameter ratio than the larger dimples.

I claim:

1. In a golf ball characterized by enhanced flight distance and enhanced aerodynamic symmetry, the ball having a generally spherical surface with dimple patterns thereon, the improvement comprising:

a) between about 75% and 85% of the ball spherical surface occupied by the dimples, b) there being smaller and larger dimples, all of which have diameters within the range of 0.110 to 0.160 inches, c) there being dimple-free multiple great circle arcs on the ball surface, which define n-sided spherical surface polygons associated with axially opposite polar zones, d) there being $n^2-2n$ of the smaller dimples within each polygon, e) the ball also having an equator, and great circle arcs also defining multiple spherical surface triangles with legs on said equator, f) and there being $n^2+2n$ of the smaller dimples within said triangles on each side of the ball equator.

2. The improvement of claim 1 wherein smaller dimples have a larger depth to diameter ratio than larger dimples.

3. The improvement of claim 2 wherein between 78% and 82% of the ball surface is occupied by said dimples.

4. The improvement of claim 1 wherein each polygon has five sides to define a spherical surface pentagon.

5. The improvement of claim 4 wherein there are 15 of the smaller dimples within each pentagon, and symmetrically spaced about an axis of said ball centrally intersecting the pentagon.

6. The improvement of claim 1 wherein there are eight of the smaller surface dimples within each triangle.

7. The improvement of claim 1 wherein said equator is everywhere adjacent smaller dimples.

8. The improvement of claim 1 wherein said $n^2-2n$ dimples are each $0.135\pm0.002$ inches in diameter.

9. The improvement of claim 7 wherein said $n^2+2n$ dimples are each $0.135\pm0.002$ inches in diameter.

10. The improvement of claim 8 wherein other dimples on the ball are each $0.140\pm0.002$ inches in diameter.

* * * * *